US012031343B2

(12) United States Patent
Dandurand

(10) Patent No.: US 12,031,343 B2
(45) Date of Patent: Jul. 9, 2024

(54) JOIST ALIGNMENT TOOL

(71) Applicant: Billy Dandurand, Healy, KS (US)

(72) Inventor: Billy Dandurand, Healy, KS (US)

( * ) Notice: Subject to any disclaimer, the term of this patent is extended or adjusted under 35 U.S.C. 154(b) by 656 days.

(21) Appl. No.: 17/123,249

(22) Filed: Dec. 16, 2020

(65) Prior Publication Data

US 2021/0180348 A1 Jun. 17, 2021

Related U.S. Application Data

(60) Provisional application No. 62/948,596, filed on Dec. 16, 2019.

(51) Int. Cl.
*E04G 21/18* (2006.01)

(52) U.S. Cl.
CPC ..... *E04G 21/185* (2013.01)

(58) Field of Classification Search
CPC ..... E04G 21/185
See application file for complete search history.

(56) References Cited

U.S. PATENT DOCUMENTS

| | | | | |
|---|---|---|---|---|
| 4,375,724 | A * | 3/1983 | Brock | G01B 3/56 33/529 |
| 4,606,110 | A | 8/1986 | Goserud | |
| 5,383,320 | A | 1/1995 | Sorton | |
| 6,513,286 | B2 | 2/2003 | Vierra | |
| 7,343,688 | B2 * | 3/2008 | Price | B43L 7/02 33/418 |
| 7,478,483 | B2 * | 1/2009 | Wrzyszczynski | E21B 41/04 33/645 |
| 7,877,889 | B2 * | 2/2011 | Griffin, Jr. | E04G 21/185 33/562 |
| 8,448,348 | B1 * | 5/2013 | Jones | E04G 21/1891 33/760 |
| 8,713,811 | B2 * | 5/2014 | Carrell | B25H 7/005 33/529 |
| 9,194,138 | B2 | 11/2015 | Gower et al. | |
| 10,132,093 | B2 * | 11/2018 | Woodruff | E04G 21/1891 |
| 2007/0193193 | A1 | 8/2007 | Lewis | |
| 2007/0220760 | A1 * | 9/2007 | Price | B43L 7/14 33/42 |

(Continued)

FOREIGN PATENT DOCUMENTS

| | | | | |
|---|---|---|---|---|
| GB | 2451853 A * | 2/2009 | | E04B 1/2608 |
| WO | WO-2018107215 A1 * | 6/2018 | | |

*Primary Examiner* — Yaritza Guadalupe-McCall
(74) *Attorney, Agent, or Firm* — Boudwin Intellectual Property Law, LLC; Daniel Boudwin

(57) ABSTRACT

A joist alignment tool is provided. The device includes a first planar base perpendicularly affixed to a second planar base at a junction. A first pair of sidewalls extend from opposing sides of the first planar base defining a first channel therebetween. A second pair of sidewalls extend from opposing sides of the second planar base defining a second channel therebetween. An opening is disposed through one of the second pair of sidewalls at the junction. A first aperture is disposed through one of the first pair of sidewalls, and a second aperture is disposed through one of the second pair of sidewalls. A first clamp is engaged with the first aperture and can frictionally engage an object disposed within the first channel. A second clamp is engaged with the second aperture and can frictionally engage an object disposed within the second channel.

16 Claims, 4 Drawing Sheets

(56) References Cited

U.S. PATENT DOCUMENTS

| | | | | |
|---|---|---|---|---|
| 2009/0223165 | A1* | 9/2009 | Griffin, Jr. | E04G 21/185<br>52/703 |
| 2013/0276316 | A1* | 10/2013 | Carrell | B25H 7/005<br>33/290 |
| 2020/0094381 | A1* | 3/2020 | Molina | B25B 5/14 |
| 2021/0180348 | A1* | 6/2021 | Dandurand | E04G 21/185 |
| 2021/0180349 | A1* | 6/2021 | Dandurand | E04G 21/1891 |

* cited by examiner

JOIST ALIGNMENT TOOL

CROSS REFERENCE TO RELATED APPLICATIONS

This application claims the benefit of U.S. Provisional Application No. 62/948,596 filed on Dec. 16, 2019. The above identified patent application is herein incorporated by reference in its entirety to provide continuity of disclosure.

BACKGROUND OF THE INVENTION

The present invention relates to joist alignment tool. More particularly, the present invention pertains to a tool having a pair of perpendicularly aligned channels allowing joists to be secured and aligned during assembly of a frame.

When framing walls and decks, various joists, boards, and other lumber must be properly aligned before being secured together. This often requires multiple individuals to ensure that the boards are properly aligned. Unfortunately, this often represents an undesirable usage of manpower on a worksite, causing the overall task to take longer than desired to complete. Additionally, human error can still result in uneven alignment of frame elements, which may require the entire process to be restarted, resulting in further inefficiencies. Furthermore, boards and joists must be spaced evenly when assembling a frame, however, such even spacing can be difficult to achieve without assistance. Therefore, a device that can easily and efficiently align, space, and support a frame during assembly is desired.

In light of the devices disclosed in the known art, it is submitted that the present invention substantially diverges in design elements from the known art and consequently it is clear that there is a need in the art for an improvement to existing joist alignment tools. In this regard, the instant invention substantially fulfills these needs.

SUMMARY OF THE INVENTION

In view of the foregoing disadvantages inherent in the known types of joist alignment tools now present in the known art, the present invention provides a joist alignment tool wherein the same can be utilized for providing convenience for the user when aligning and securing various frame members together during frame assembly.

The present system comprises a first planar base perpendicularly affixed to a second planar base at a junction. A first pair of sidewalls extend from opposing sides of the first planar base defining a first channel therebetween. A second pair of sidewalls extend from opposing sides of the second planar base defining a second channel therebetween. An opening is disposed through one of the second pair of sidewalls at the junction between the first planar base and the second planar base. A first aperture is disposed through one of the first pair of sidewalls, and a second aperture is disposed through one of the second pair of sidewalls. In some embodiments, the second aperture is coaxial with a longitudinal axis of the first channel. A first clamp is engaged with the first aperture and is configured to frictionally engage an object disposed within the first channel. A second clamp is engaged with the second aperture and is configured to frictionally engage an object disposed within the second channel.

In some embodiments, the first planar base is affixed at a midpoint of the second planar base. In another embodiment, each of the first pair of sidewalls are affixed to one of the second pair of sidewalls along opposing ends of the opening.

In other embodiments, the first pair of sidewalls extend orthogonally from the first planar base. In yet another embodiment, the first planar base is coplanar with the second planar base. In some embodiments, the first and second clamps comprise a threaded bolt having a handle perpendicularly affixed thereto, wherein the threaded bolt is configured to engage with interior threading disposed through each of the first and second apertures. In another embodiment, a neck extends from one sidewall of each of the first and second pairs of sidewalls about each of the first and second apertures. In other embodiments, the neck further comprises interior threading configured to engage complementary threading disposed on each of the first and second clamps.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
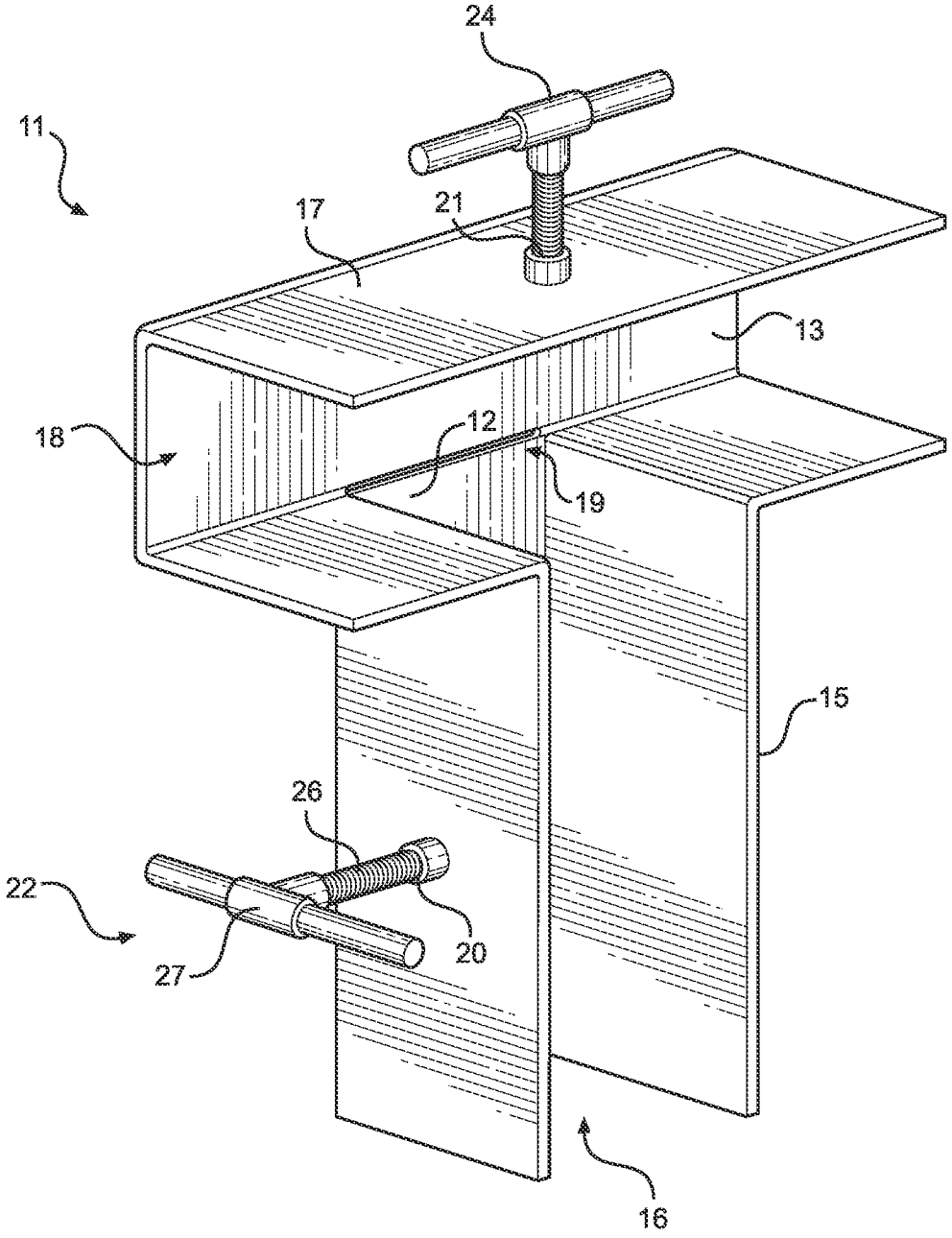
FIG. 1 shows an exploded view of an embodiment of the joist alignment tool.

Reference is made herein to the attached drawings. Like reference numerals are used throughout the drawings to depict like or similar elements of the joist alignment tool. The figures are intended for representative purposes only and should not be considered to be limiting in any respect.

Referring now to FIG. 1, there is shown an exploded view of an embodiment of the joist alignment tool. The joist alignment tool 11 comprises a first planar base 12 perpendicularly affixed to a second planar base 13. In the shown embodiment, the first planar base 12 is disposed along a midpoint of the second planar base 13 forming a substantially T-shaped device. A first pair of sidewalls 15 extend orthogonally from opposing lateral sides of the first planar base 12 defining a first channel 16 therebetween. Similarly, a second pair of sidewalls 17 extends orthogonally from opposing lateral sides of the second planar base 13 defining a second channel 18 therebetween. In some embodiments, the first and second pairs of sidewalls 15, 17 are contemplated to be integral and unitary with the first and second planar bases 12, 13, respectively. The first and second planar bases 12, 13 and the first and second pairs of sidewalls 15, 17 further comprise a rigid material, such that the joist alignment tool 11 does not deform during use. The first and second channels 16, 18 are dimensioned to removably secure joists or other lumber therein, such that a user can easily and efficiently align and secure joists together at a right angle when building a frame.

An opening 19 is disposed along one sidewall of the second pair of sidewalls 17, such that the first channel 16 is open and continuous with the second channel 18. In this manner, a user can readily secure a pair of perpendicular joist members within each channel 16, 18 together by affixing one or more fasteners through each joist member through the opening 19. In some embodiments, the first pair of sidewalls 15 are integral and unitary with one sidewall of the second pair of sidewalls 17 on opposing sides of the opening 19, such that the joist alignment tool 11 is provided additional structural integrity. Furthermore, this arrangement minimizes flexion of the first and second pairs of sidewalls 15, 17 during use when a joist or other lumber is secured within each channel 16, 18.

A first clamp 22 is removably securable to the first pair of sidewalls 15 via a first aperture 20 disposed through one sidewall of the first pair of sidewalls 15. Similarly, a second clamp 24 is removably securable to the second pair of sidewalls 17 via a second aperture 21 disposed through one sidewall of the second pair of sidewalls 17. The first and second clamps 22, 24 are configured to extend into the first and second channels 16, 18 respectively to frictionally engage a joist therein, such that the joist is secured between each clamp 22, 24 and an opposing sidewall of the first and second pairs of sidewalls 15, 17 respectively. In the illustrated embodiment, each clamp 22, 24 comprises a threaded rod 26 perpendicularly affixed to a handle 27 along a midpoint thereof, wherein the threaded rod 26 engages threads disposed within each aperture 20, 21. The handle 27 provides a gripping surface, allowing the user to selectively tighten or loosen each clamp 22, 24 by hand. In this manner, supplemental tools, such as wrenches, are not necessary to secure the joist within the first and second channels 16, 18, as the forces applied via supplemental tools can damage or split the joist.

Figure 2:
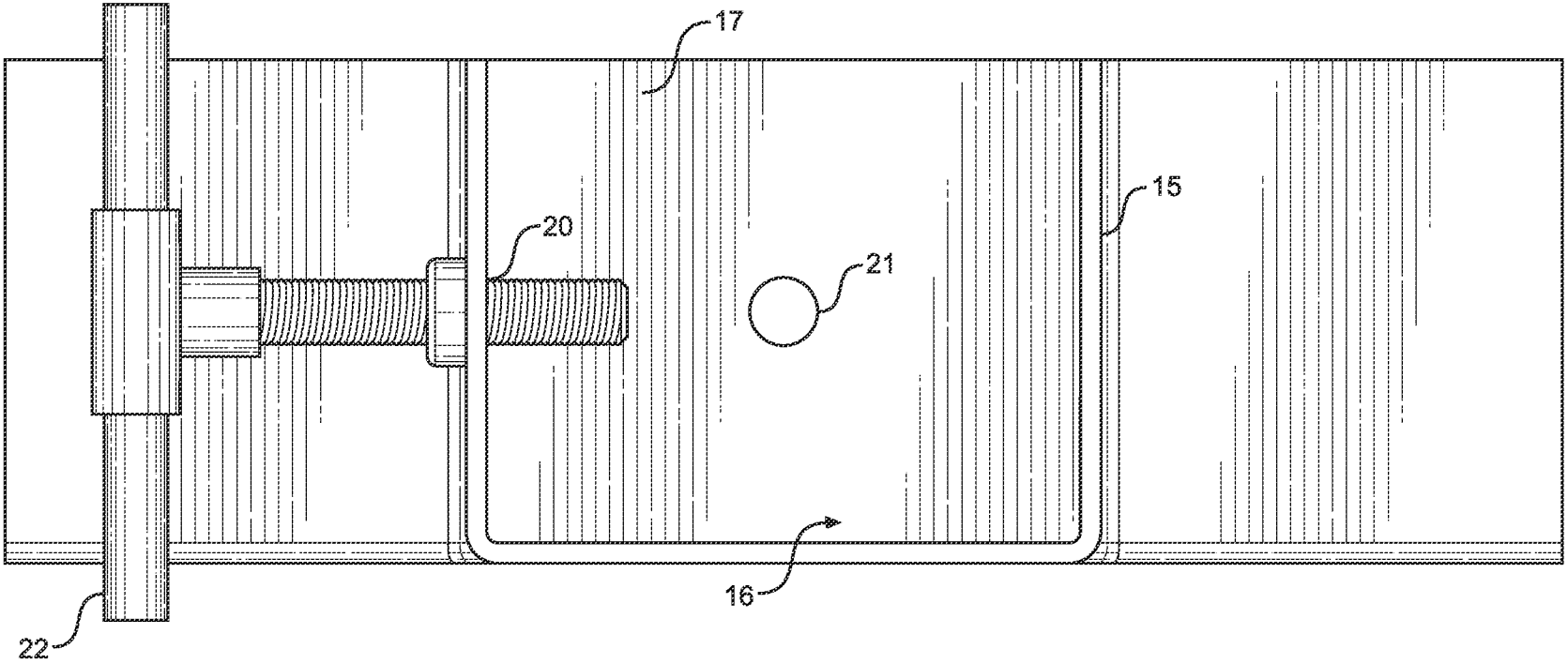
FIG. 2 shows an end view of an embodiment of the joist alignment tool.

Referring now to FIG. 2, there is shown an end view of an embodiment of the joist alignment tool. The first clamp 22 adjustably extends into the first channel 16 as desired to secure a joist therein, such that the joist is frictionally engaged by the first clamp 22 and a sidewall of the first pair of sidewalls 15 opposite the aperture 20. Similarly, a second joist can be secured within the second channel via a second clamp inserted through the second aperture 21 within one sidewall of the second pair of sidewalls 17. In the shown embodiment, the second aperture 21 is coaxially aligned with a longitudinal axis of the first channel 16, thereby ensuring that any forces applied by the second clamp via the second aperture 21 to secure a joist within the second channel are focused along the longitudinal axis of the first channel 16. In this manner, a user ensures that each joist member is retained at least along a point of contact between the first and second joist members within the first channel 16 and the second channel, respectively, such that the user can easily and efficiently fasten each joist member together.

Figure 3:
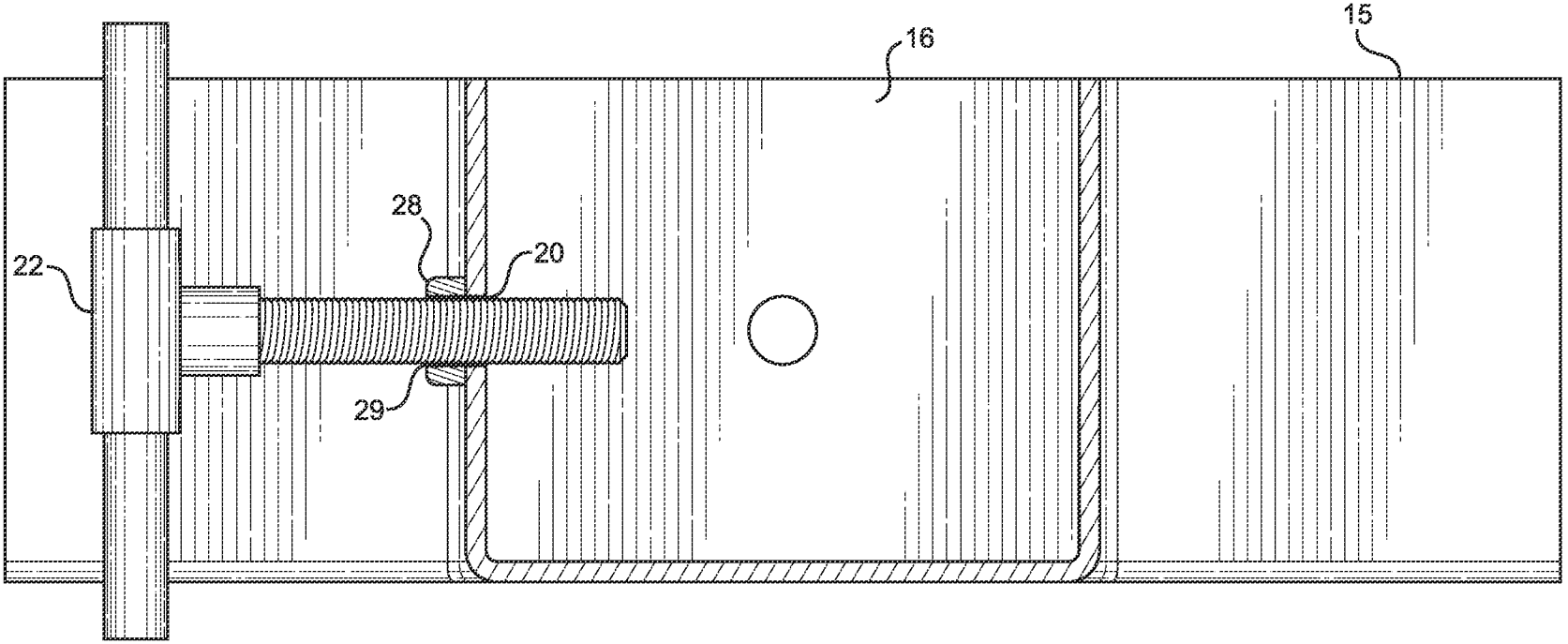
FIG. 3 shows a cross-sectional view of an embodiment of the joist alignment tool.

Referring now to FIG. 3, there is shown a cross-sectional view of an embodiment of the joist alignment tool. In the illustrated embodiment, a neck 28 extends from a sidewall of the first pair of sidewalls 15 opposite the first channel 16 about the first aperture 20. Similarly, another neck 28 extends from a sidewall of the second pair of sidewalls opposite the second channel about the second aperture. The following description is focused on the neck 28 as it relates to the first channel 16 and the first pair of sidewalls 15 for brevity, however this description can be similarly applied to the neck 28 disposed on one of the second pair of sidewalls. The neck 28 functionally extends the length of the first aperture 20, thereby providing additional support and stability to the threaded rod of the first clamp 22 during use. In the shown embodiment, complementary threading on the threaded rod engages interior threading 29 extending through the neck 28 and the first aperture 20 to allow the user to selectively extend the threaded rod into the first channel 16 to clamp a joist therein.

Figure 4:
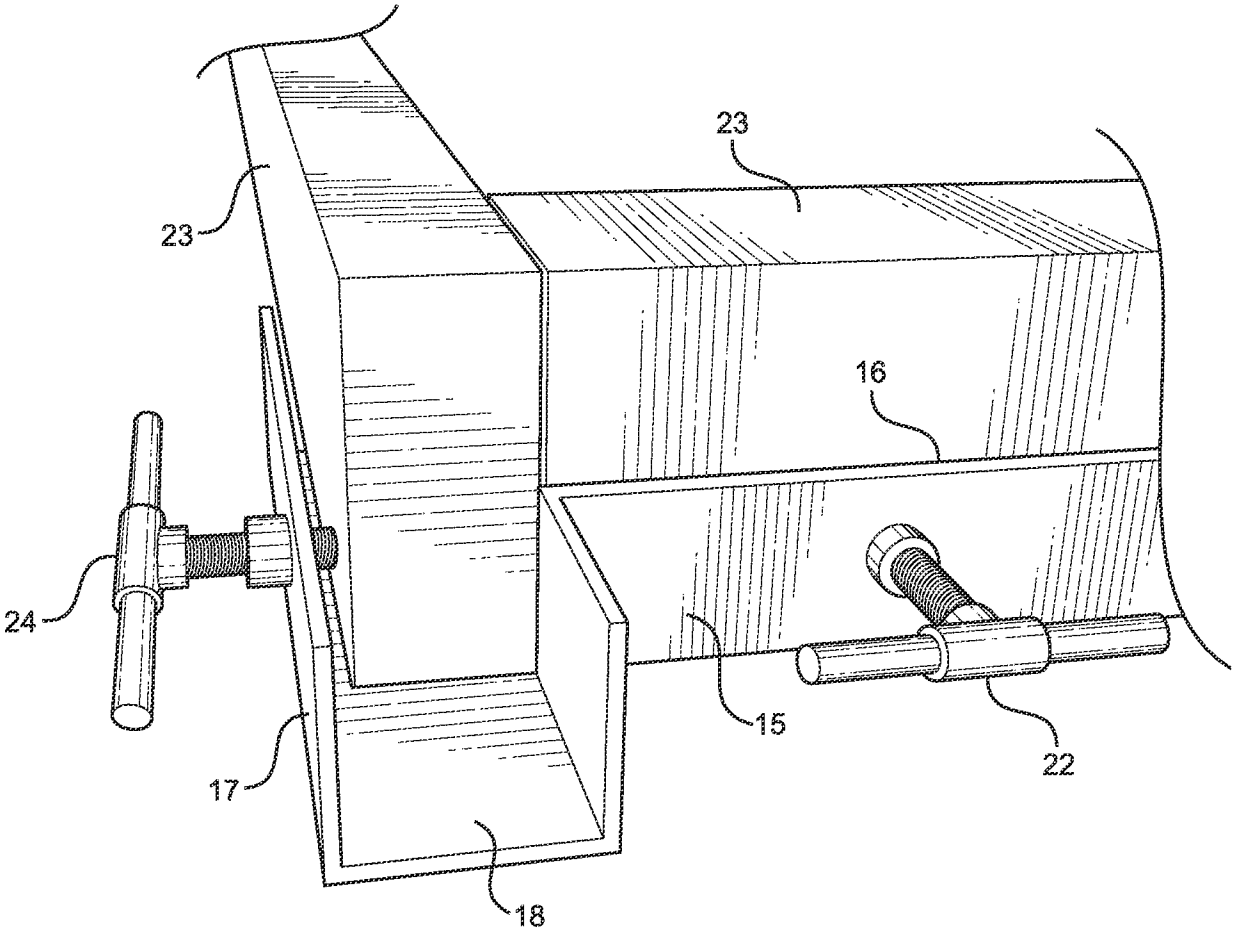
FIG. 4 shows a perspective view of an embodiment of the joist alignment tool in use.

Referring now to FIG. 4, there is shown a perspective view of an embodiment of the joist alignment tool in use. In one use, a joist 23 is inserted into each of the first and second channels 16, 18, such that the joists 23 are perpendicularly aligned. Once the pair of joists 23 are positioned as desired relative to each other, the first clamp 22 and the second clamp 24 can then be actuated to insert the threaded rods into the first and second channels 16, 18 to frictionally engage each joist 23. In this manner, the user can retain the joists 23 in perpendicular alignment when assembling a frame until the joists 23 are secured together. In the illustrated embodiment, the first and second pairs of sidewalls 15, 17 comprise a height less than that of each joist 23, such that a user can secure a fastener through each joist 23 above the sidewalls 15, 17. Multiple joist alignment tools can be utilized in tandem to assemble an entire frame before securing any joists 23 together via fasteners, thereby minimizing the risk of mistakes that would necessitate disassembling the frame.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A joist alignment tool, comprising:

a first planar base perpendicularly affixed to a second planar base at a junction;

a first pair of sidewalls extending from opposing sides of the first planar base defining a first channel therebetween;

a second pair of sidewalls extending from opposing sides of the second planar base defining a second channel therebetween;

an opening disposed through one of the second pair of sidewalls at the junction between the first planar base and the second planar base;

a first aperture disposed through one of the first pair of sidewalls;

a second aperture disposed through one of the second pair of sidewalls;

a first clamp engaged with the first aperture and configured to frictionally engage an object disposed within the first channel;

a second clamp engaged with the second aperture and configured to frictionally engage an object disposed within the second channel; and further comprising a neck extending from one sidewall of each of the first and second pairs of sidewalls about each of the first and second apertures.

2. The joist alignment tool of claim 1, wherein the first planar base is affixed at a midpoint of the second planar base.

3. The joist alignment tool of claim 1, wherein each of the first pair of sidewalls are affixed to one of the second pair of sidewalls along opposing ends of the opening.

4. The joist alignment tool of claim 1, wherein the first pair of sidewalls extends orthogonally from the first planar base.

5. The joist alignment tool of claim 1, wherein the second pair of sidewalls extends orthogonally from the second planar base.

6. The joist alignment tool of claim 1, wherein the first planar base is coplanar with the second planar base.

7. The joist alignment tool of claim 1, wherein each of the first and second clamps comprise a threaded bolt having a handle perpendicularly affixed thereto, wherein the threaded bolt is configured to engage with interior threading disposed through each of the first and second apertures.

8. The joist alignment tool of claim 1, wherein the neck further comprises interior threading configured to engage complementary threading disposed on each of the first and second clamps.

9. A joist alignment tool, comprising:

a first planar base perpendicularly affixed to a second planar base at a junction;

a first pair of sidewalls extending from opposing sides of the first planar base defining a first channel therebetween;

a second pair of sidewalls extending from opposing sides of the second planar base defining a second channel therebetween;

an opening disposed through one of the second pair of sidewalls at the junction between the first planar base and the second planar base;

a first aperture disposed through one of the first pair of sidewalls;

a second aperture disposed through one of the second pair of sidewalls;

wherein the second aperture is coaxial with a longitudinal axis of the first channel;

a first clamp engaged with the first aperture and configured to frictionally engage an object disposed within the first channel;

a second clamp engaged with the second aperture and configured to frictionally engage an object disposed within the second channel; and further comprising a neck extending from one sidewall of each of the first and second pairs of sidewalls about each of the first and second apertures.

10. The joist alignment tool of claim 9, wherein the first planar base is affixed at a midpoint of the second planar base.

11. The joist alignment tool of claim 9, wherein each of the first pair of sidewalls are affixed to one of the second pair of sidewalls along opposing ends of the opening.

12. The joist alignment tool of claim 9, wherein the first pair of sidewalls extends orthogonally from the first planar base.

13. The joist alignment tool of claim 9, wherein the second pair of sidewalls extends orthogonally from the second planar base.

14. The joist alignment tool of claim 9, wherein the first planar base is coplanar with the second planar base.

15. The joist alignment tool of claim 9, wherein each of the first and second clamps comprise a threaded bolt having a handle perpendicularly affixed thereto, wherein the threaded bolt is configured to engage with interior threading disposed through each of the first and second apertures.

16. The joist alignment tool of claim 9, wherein the neck further comprises interior threading configured to engage complementary threading disposed on each of the first and second clamps.

* * * * *